US011703272B2

(12) United States Patent
Garcia et al.

(10) Patent No.: US 11,703,272 B2
(45) Date of Patent: Jul. 18, 2023

(54) DRAWER-SHELF SYSTEM FOR A REFRIGERATOR APPLIANCE

(71) Applicant: WHIRLPOOL CORPORATION, Benton Harbor, MI (US)

(72) Inventors: Fernando Garcia, Apodaca (MX); Diego De Jesus Garza Valdes, Apodaca (MX)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 17/522,500

(22) Filed: Nov. 9, 2021

(65) Prior Publication Data

US 2023/0145594 A1 May 11, 2023

(51) Int. Cl.
*F25D 25/02* (2006.01)
*F25D 23/06* (2006.01)

(52) U.S. Cl.
CPC ..... *F25D 25/025* (2013.01); *F25D 25/02* (2013.01); *F25D 23/067* (2013.01); *F25D 2325/022* (2013.01)

(58) Field of Classification Search
CPC ..... F25D 25/025; F25D 23/067; F25D 2325/022; F25D 25/02
See application file for complete search history.

(56) References Cited

U.S. PATENT DOCUMENTS 4,729,613 A * 3/1988 Tromble ..... F25D 25/021 312/270.3
4,870,836 A 10/1989 Pink
4,960,308 A * 10/1990 Donaghy ..... F25D 25/025 D15/89
5,044,704 A * 9/1991 Bussan ..... F25D 25/025 312/402
5,641,217 A * 6/1997 Caruso ..... F25D 25/025 312/334.23
7,497,533 B2 * 3/2009 Remmers ..... A47B 96/063 211/90.01
8,403,437 B2 * 3/2013 Bergmann ..... F25D 25/021 312/334.1
10,485,250 B2 11/2019 Carballo
2008/0202146 A1 8/2008 Lim et al.
2018/0325148 A1 * 11/2018 Carballo ..... F25D 25/025

FOREIGN PATENT DOCUMENTS

CN 207674812 U 7/2018
CN 103673489 B 1/2019
CN 211926283 U 11/2020

* cited by examiner

*Primary Examiner* — Kimberley S Wright
(74) *Attorney, Agent, or Firm* — Brooks Kushman P.C.

(57) ABSTRACT

A drawer-shelf system for a refrigerator includes a drawer, a support rail, and a shelf plate. The drawer has a ridge protruding therefrom. The support rail defines a first channel along a side of the support rail. The first channel is configured to receive the ridge such that the drawer is slidable relative to and supported by the support rail. The support rail has a protrusion extending upward from a first end of the support rail. The protrusion defines a second channel. The shelf plate has an outer edge extending about an outer periphery of the shelf. A first portion of the outer edge is configured to be disposed within the second channel such that the shelf plate is supported by the first end.

20 Claims, 4 Drawing Sheets

DRAWER-SHELF SYSTEM FOR A REFRIGERATOR APPLIANCE

TECHNICAL FIELD

The present disclosure relates to an appliance such as a refrigerator.

BACKGROUND

In order to keep food fresh, a low temperature must be maintained within a refrigerator to reduce the reproduction rate of harmful bacteria. Refrigerators circulate refrigerant and change the refrigerant from a liquid state to a gas state by an evaporation process in order cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

SUMMARY

A refrigerator drawer-shelf system includes a refrigerator, a support rail, a crisper drawer, and a planar shelf. The refrigerator defines an internal cavity and has at least one shelf support protruding into the internal cavity. The support rail defines a crisper drawer support channel on an internal side of the support rail. The support rail defines a shelf mounting recess along a top of the support rail, along a back end of the support rail, and above the crisper drawer support channel. The crisper drawer has a support lip configured to slidably engage the crisper drawer support channel. The planar shelf has an outer edge extending about an outer periphery of the shelf. A portion of the outer edge is configured to slidably engage the shelf mounting recess to secure the shelf to the support rail such that the support rail supports at least a portion of a weight of the shelf.

A drawer-shelf system for a refrigerator includes a crisper drawer, first and second opposing spaced-apart support rails, and a planar shelf. The crisper drawer has first and second ridges extending outward from opposing first and second sides of crisper drawer. The first and second support rails define first and second channels along first and second internal sides of the first and second support rails, respectively. The first and second channels receive the first and second ridges, respectively, (i) to support the crisper drawer and (ii) such that the crisper drawer is slidable relative to the first and second support rails. The first and second support rails have first and second protrusions extending upward from first and second back ends of the first and second support rails, respectively. The first and second protrusions define first and second C-channels, respectively. The first and second C-channels have first and second forward facing open ends, respectively. The planar shelf has an outer edge extending about an outer periphery of the shelf. A back portion of the outer edge is disposed within the first and second C-channels such that the planar shelf is supported by the first and second back ends.

A drawer-shelf system for a refrigerator includes a drawer, a support rail, and a shelf plate. The drawer has a ridge protruding therefrom. The support rail defines a first channel along a side of the support rail. The first channel is configured to receive the ridge such that the drawer is slidable relative to and supported by the support rail. The support rail has a protrusion extending upward from a first end of the support rail. The protrusion defines a second channel. The shelf plate has an outer edge extending about an outer periphery of the shelf. A first portion of the outer edge is configured to be disposed within the second channel such that the shelf plate is supported by the first end.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
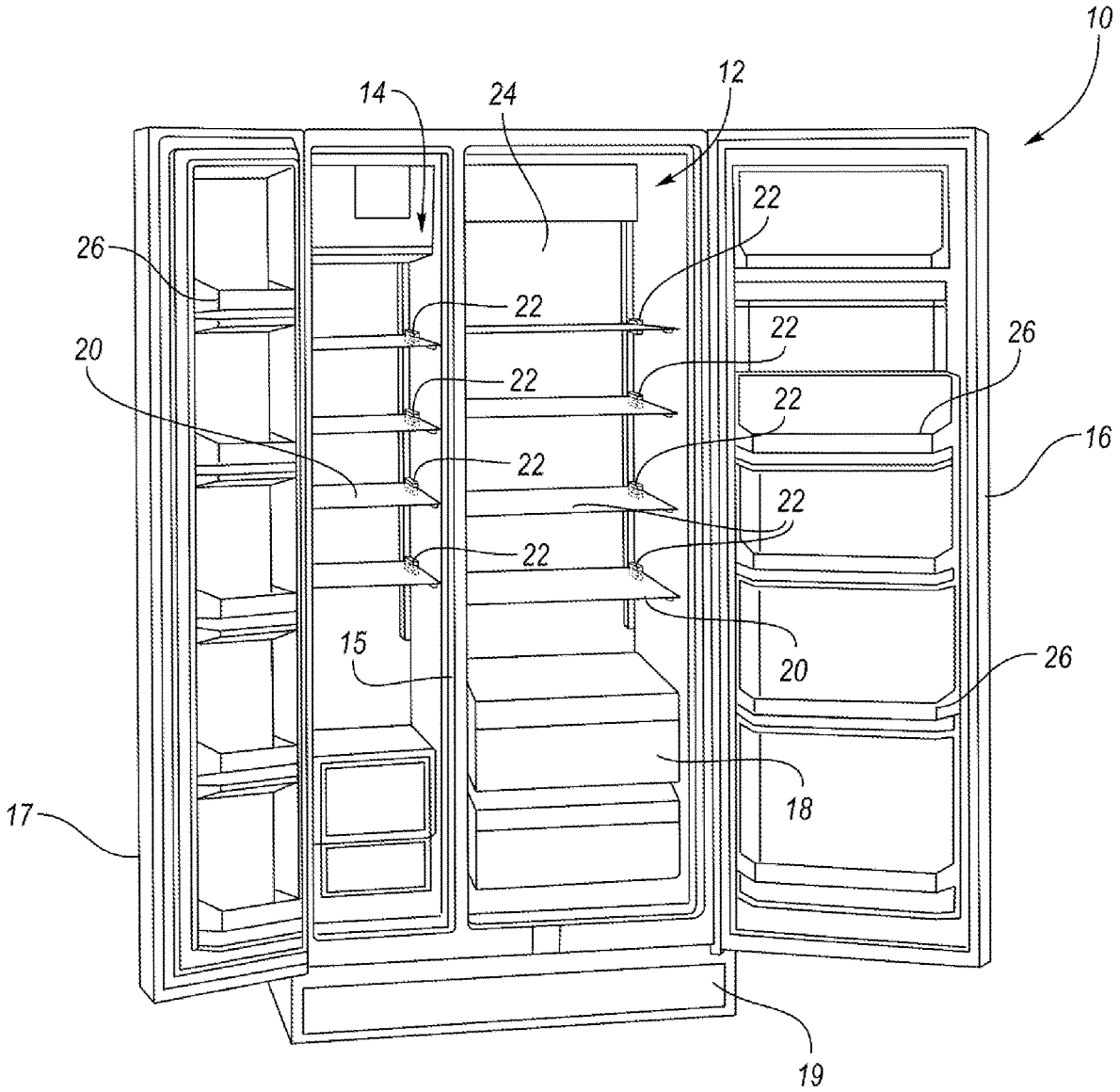
FIG. 1 is a front perspective front view of a side-by-side type refrigerator.

Referring to FIG. 1, generally a refrigerator 10 of the side-by-side type is illustrated. However, it should be understood that this disclosure could apply to any type of refrigerator, such as a side-by-side, French-Door Bottom Mount, or a top-mount type. The refrigerator 10 defines internal cavities. More specifically, the refrigerator 10 defines a fresh food or refrigeration compartment 12 and a freezer compartment 14 that are separated by a dividing wall 15. It is generally known that the freezer compartment 14 is typically kept at a temperature below the freezing point of water, and the refrigeration compartment 12 is typically kept at a temperature above the freezing point of water and generally below a temperature of from about 35° F. to about 50° F., more typically below about 38° F.

The interior of refrigerator 10, including the refrigeration compartment 12 and the freezer compartment 14, is cooled by an evaporator (not shown) that is part of a refrigerant circuit. The evaporator may be located in the freezer compartment. The refrigerant circuit also includes a compressor (not shown) and a condenser (not shown), which may be located in a machinery compartment 19. The condenser is configured to reject heat from the refrigerant circuit to the ambient surroundings. Fans may be utilized to direct air across the evaporator and the condenser to facilitate exchanging heat. The compressor and the fans may be connected to a controller. Sensors that measure the air temperature within the refrigeration compartment 12 and the freezer compartment 14 may be in communication with the controller. The controller may be configured to operate the compressor, fans, etc. in response to the air temperature within the refrigeration compartment 12 and the freezer compartment 14 being less than a threshold.

Such a controller may be part of a larger control system and may be controlled by various other controllers throughout the refrigerator 10, and one or more other controllers can collectively be referred to as a "controller" that controls various functions of the refrigerator 10 in response to inputs or signals to control functions of the refrigerator 10. The controller may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the refrigerator 10.

The refrigerator has openable doors 16 and 17 providing access to the interior of the refrigeration compartment 14 and the freezer compartment 14, respectively. The refrigeration compartment 12 is provided with one or more drawers 18 for storing food and one or more shelves 20 for storing food. The drawers 18 may more specifically be crisper drawers that are slidably secured to the internal walls or liner walls 24 within the refrigeration compartment 12. Crisper drawers define storage spaces that are kept at a desired humidity that may be different from the remainder of the refrigeration compartment 12, but that is optimal for maintaining freshness of fruits and vegetables. The drawers 18 and shelves 20 are supported by shelf supports 22, that are secured to the liner walls 24 of the refrigeration compartment 12 and protrude into the refrigeration compartment 12. The freezer compartment 14 may also include shelves 20 that are supported by shelf supports 22. Door shelves 26 are secured to the interior sides of doors 16, 17. The door shelves 26 may be secured to the interior sides of doors 16, 17 via shelf supports or may be permanently affixed to the interior sides of doors 16, 17.

Figure 2:
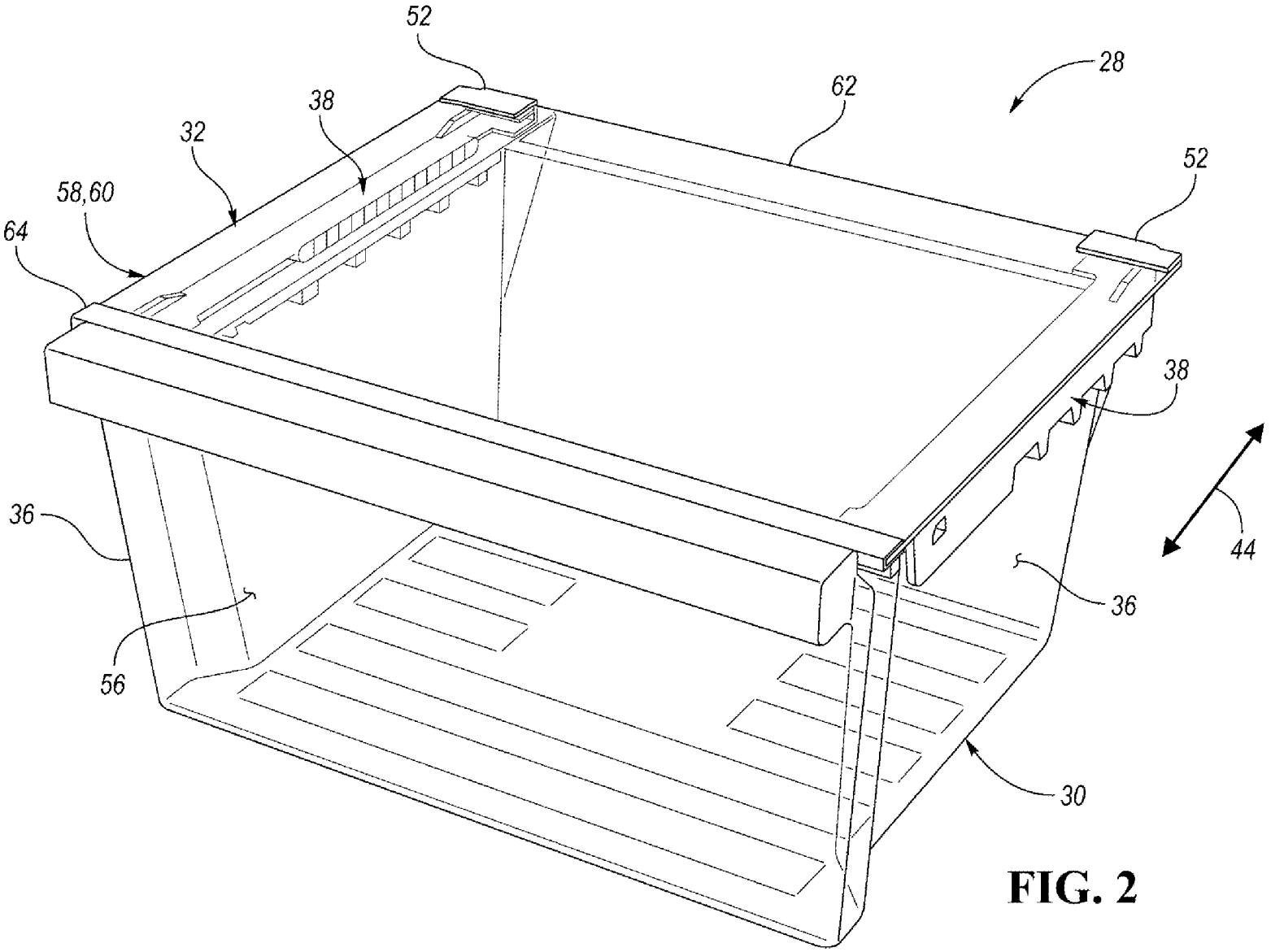
FIG. 2 is a perspective front view of a drawer-shelf system that is utilized in the refrigerator.
Figure 3:
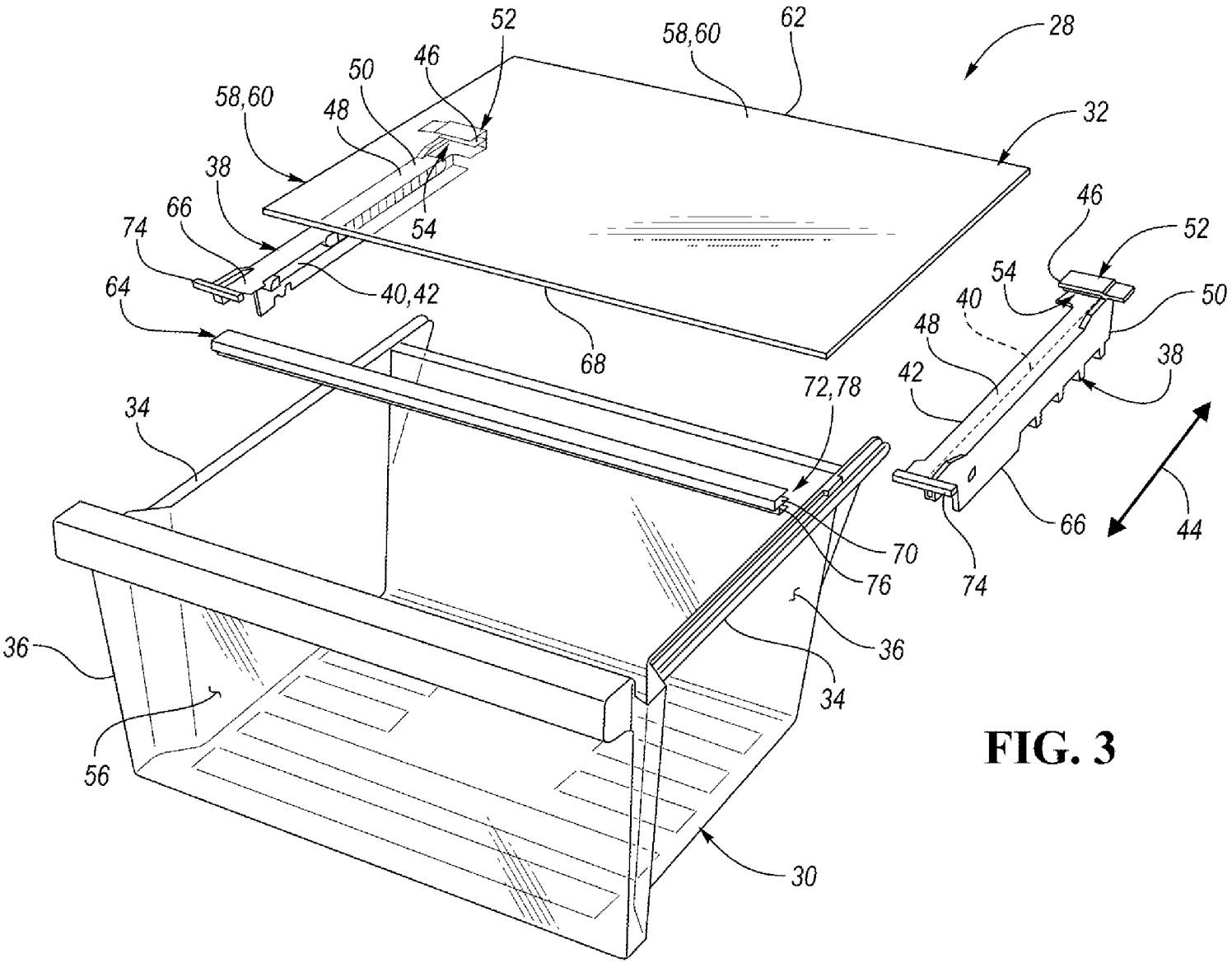
FIG. 3 is a perspective exploded view of the drawer-shelf system that is utilized in the refrigerator.

Referring to FIGS. 2 and 3, a drawer-shelf system 28 for the refrigerator 10 is illustrated. The drawer-shelf system 28 may more specifically, be a combination of a drawer 30 (e.g., drawer 18) and a shelf 32 (e.g., shelf 20). The drawer 30 and the shelf 32 are illustrated as being constructed from a transparent material (e.g., a transparent glass or plastic). However, it should be understood that the drawer 30 and shelf 32 may be made from non-transparent materials. The drawer 30 may more specifically be a crisper drawer. The drawer 30 has at least one support lip or ridge 34 protruding therefrom. More specifically, the drawer 30 may have first and second ridges 34 extending outward from opposing first and second sides 36 of the drawer 30.

The drawer-shelf system 28 includes at least one support rail 38 defining a drawer support channel 40 on an internal side 42 of at least one support rail 38. More specifically, the drawer-shelf system 28 may include first and second opposing spaced-apart support rails 38 defining first and second drawer support channels 40 along first and second internal sides 42 of the first and second support rails 38, respectively. The first and second crisper drawer support channels 40 are configured to receive the first and second ridges 34, respectively, to support the drawer 30 and such that the drawer 30 is slidable relative to the first and second support rails 38. More specifically, the first and second ridges 34 are configured to slidably engage the first and second drawer support channels 40, respectively, such the drawer 30 is slidable in a direction 44 from front to back ends of the first and second support rails 38, between an open position and a closed position.

Each support rail 38 defines a shelf mounting recess, channel, or C-channel 46 along a top 48 of the respective support rail 38, along a first or back end 50 of the respective support rail 38, and above the respective drawer support channel 40. Each support rail 38 may include a protrusion 52 extending upward from back end 50 of the support rail 38. Each protrusion 52 may define one of the shelf mounting recesses, channels, or C-channels 46. More specifically, the first and second support rails 38 may have first and second protrusions 52 extending upward from first and second back ends 50 of the first and second support rails 38, respectively, wherein the first and second protrusions 52 define first and second shelf mounting recesses, channels, or C-channels 46, respectively. Each shelf mounting recess, channel, or C-channel 46 may have forward facing open ends 54 (e.g., open ends that face toward a front side 56 of the drawer 30.

The shelf 32 may be a planar shelf or a plate forming a shelf. The shelf 32 has an outer edge 58 extending about an outer periphery 60 of the shelf 32. Portions of the outer edge 58 are configured to slidably engage the shelf mounting recesses, channels, or C-channels 46 to secure the shelf 32 to the support rails 38 such that each support rail 38 supports at least a portion of a weight of the shelf 32. Stated in other terms, portions of the outer edge 58 are configured to be disposed within the shelf mounting recesses, channels, or C-channels 46 of each support rail 38 such that the shelf 32 is supported by the back ends 50 of each support rail 38. More specifically, the portions of the outer edge 58 that are disposed within the shelf mounting recesses, channels, or C-channels 46 of each support rail 38 may be portions of a back edge or back portion 62 of the outer edge 58.

The drawer-shelf system 28 may further include a support bar 64 configured to secure a portion of the outer edge 58 to second or front ends 66 of the support rails 38. The portion the outer edge 58 that is secured to front ends 66 of the support rails 38 may be a front edge or front portion 68 of the outer edge 58. The support bar 64 defines a shelf mounting recess, channel, or C-channel 70. The front portion 68 of the outer edge 58 is configured to be or is disposed within the shelf mounting recess, channel, or C-channel 70.

The front ends 66 of the support rails 38 are opposite to the back ends 50 of the support rails 38 (e.g., the front ends 66 of the support rails 38 are on opposite ends of the support rails 38 relative to the back ends 50). The front portion 68 of the outer edge 58 is opposite to the back portion 62 of the outer edge 58 (e.g., the front portion 68 of the outer edge 58 is on an opposite end of the shelf 32 relative to the back portion 62 of the outer edge 58). The shelf mounting recess, channel, or C-channel 70 has a rearward facing open end 72 that faces the open ends 54 of the shelf mounting recesses, channels, or C-channels 46.

The drawer-shelf system 28 may further include horizontally extending posts 74 disposed on and extending upward from the front ends 66 of each support rail 38. The support bar 64 may engage the horizontally extending posts 74 to secure the front portion 68 of the outer edge 58 to the front ends 66 of the support rails 38. More specifically, the support bar 64 may engage the horizontally extending posts 74 to secure the shelf 32 to the front ends 66 of the support rails 38 such that each front end 66 of each support rail 38 supports at least a portion of a weight of the shelf 32. The support bar 64 may further define a channel or C-channel 76 that is disposed below the shelf mounting recess, channel, or C-channel 70. The channel or C-channel 76 may also have a rearward facing open end 78 that faces the open ends 54 of the shelf mounting recesses, channels, or C-channels 46. The horizontally extending posts 74 may be disposed within the channel or C-channel 76 in order to secure the support bar 64 and shelf 32 to the front ends 66 of the support rails 38.

Figure 4:
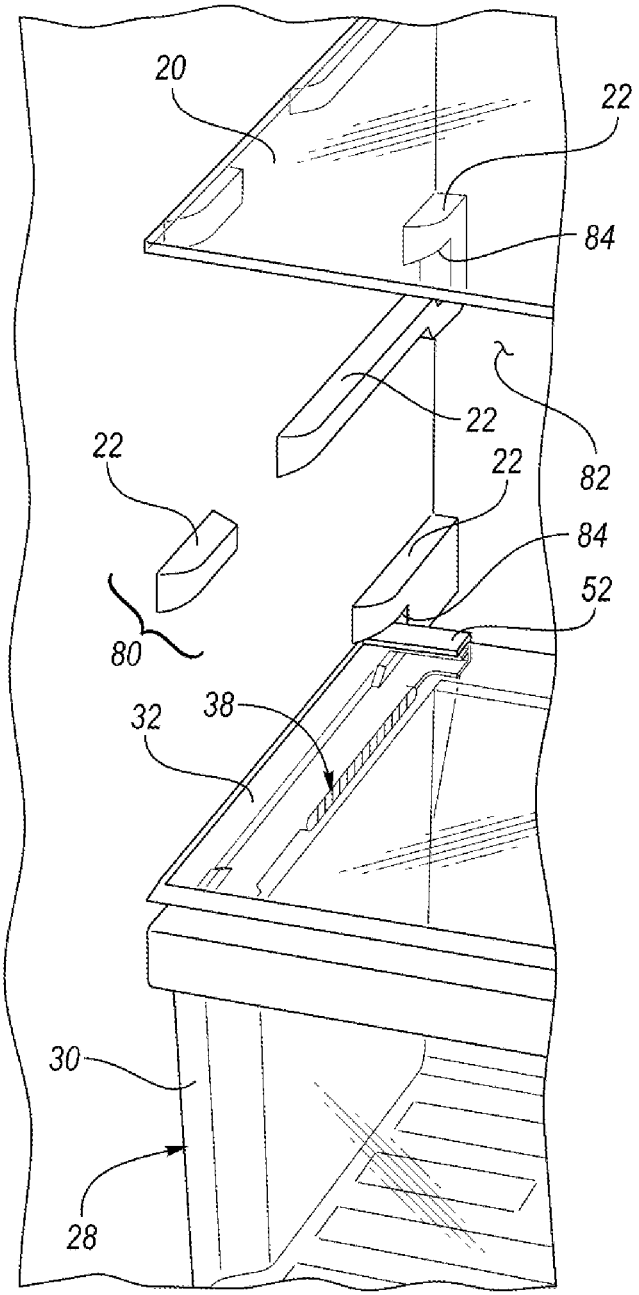
FIG. 4 is a perspective front view illustrating an engagement between the drawer-shelf system and shelf supports within the refrigerator.

Referring now to FIG. 4, a perspective front view illustrating an engagement between the drawer-shelf system 28 and shelf supports 22 within the refrigerator 10 is illustrated. The image of FIG. 4 only illustrates an engagement along one side of the drawer-shelf system 28 (e.g., the left side). It should be understood, however, that each side of the drawer-shelf system 28 may be secured to a separate shelf support 22 (e.g., the left side and the right side of the drawer-shelf system 28 may each be secured to a separate shelf support 22). Furthermore, it should be understood that each side of the drawer-shelf system 28 (e.g., the left side and the right side of the drawer-shelf system 28) may be mirror images of each other and the shelf supports engaging each side of the drawer-shelf system 28 may also be mirror image versions of each other.

The shelf supports 22 may comprise protrusions that extend from the liner walls 24 and into the internal cavities defined by the refrigerator 10 (e.g., refrigeration compartment 12 or freezer compartment 14). Sets 80 of shelf supports 22 may be configured to support a drawer 18, a shelf 20, or a drawer-shelf system 28. The shelf support 22 toward the back wall 82 of each set 80 of shelf supports 22 may define a notch 84. More specifically, the shelf support 22 toward the back wall 82 of each set 80 of shelf supports 22 may be C-shaped. It is noted that only a left side set 80 of shelf supports 22 (e.g., shelf supports 22 extending from a left side wall) is illustrated in FIG. 4. However, it should be understood each set 80 of shelf supports 22 will have a corresponding mirror image set of shelf supports (e.g., shelf supports 22 extending from a right side wall) so that each drawer 18, shelf 20, and drawer-shelf system 28 are supported on both left and right sides.

Referring more specifically to the drawer-shelf system 28 depicted in FIG. 4, each support rail 38 is configured to slidably engage the at least one shelf support 22 to secure the support rail 38 to the refrigerator 38 within an internal cavity (e.g., refrigeration compartment 12). More specifically, each protrusion 52 that extends upward from a back end 50 of each support rail 38 is configured to be received within one of the notches 84 when the support rails 38 engage the shelf supports 22.

Current designs of drawer-shelf systems include a single frame that defines the crisper drawer support channels and a cover/shelf that is disposed on the top of the single frame. This single frame, however, is not attached to the cover/shelf. The single frame, and hence the entire crisper drawer, may fall down if the customer removes the cover/shelf from the refrigerator compartment. The current application directly secures the tracks (e.g., support rails 38) to the cover/shelf (e.g., shelf 32). This helps to ensure that the tracks and the entire crisper drawer do not fall down as a result of a customer removing the cover/shelf.

The solution described herein replaces a full frame with separate spaced apart tracks. These tracks provide easy assembly to the cover/shelf increasing customer satisfaction. The force required to place tracks in a final position is small compared with the tracks that are attached with snaps. The solution described allows a drawer-shelf system 28 to slide into shelf supports (e.g., shelf supports 22) more easily.

It should be understood that the designations of first, second, third, fourth, etc. for any component, state, or condition described herein may be rearranged in the claims so that they are in chronological order with respect to the claims. Furthermore, it should be understood that any component, state, or condition described herein that does not have a numerical designation may be given a designation of first, second, third, fourth, etc. in the claims if one or more of the specific component, state, or condition are claimed.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A refrigerator drawer-shelf system comprising:

a refrigerator defining an internal cavity and having a shelf support (i) protruding into the internal cavity from an internal lateral wall of the refrigerator and (ii) defining a C-shaped notch facing toward a front of the refrigerator;

a support rail (i) defining a crisper drawer support channel on an internal side of the support rail and (ii) having a protrusion extending upward from a top surface of the support rail, along a back end of the support rail, and above the crisper drawer support channel, wherein the protrusion defines a C-channel having an open end facing toward a front of the support rail, and wherein the protrusion is disposed within the C-shaped notch such that the shelf support secures at least the back end of the support rail to the refrigerator within the internal cavity;

a crisper drawer having a support lip configured to slidably engage the crisper drawer support channel; and a planar shelf having an outer edge extending about an outer periphery of the shelf, wherein a portion of the outer edge is disposed within the C-channel to secure the shelf to the support rail such that the support rail supports at least a portion of a weight of the shelf.

2. The drawer-shelf system of claim 1, wherein the support rail is configured to slidably engage the shelf support to secure the support rail to the refrigerator within the internal cavity.

3. The drawer-shelf system of claim 1 further comprising a second support rail defining (i) a second crisper drawer support channel on an internal side of the second support rail and (ii) having a second protrusion extending upward from a top surface of the second support rail, along a back end of the second support rail, and above the second crisper drawer support channel, wherein the second protrusion defines a second C-channel having a second open end facing toward a front of the second support rail, and wherein the second protrusion is disposed within a second C-shaped notch defined by a second shelf support such that the second shelf support secures at least the back end of the second support rail to the refrigerator within the internal cavity.

4. The drawer-shelf system of claim 3, wherein at least a second portion of the outer edge is disposed within the second C-channel to secure the shelf to the second support rail such that the second support rail supports at least a second portion of the weight of the shelf.

5. The drawer-shelf system of claim 4, wherein the portion of the outer edge and the second portion of the outer edge are each portions of a back edge of the planar shelf, and wherein a middle region of the back edge is disposed between and the protrusion and the second protrusion external of the C-channel and the second C-channel.

6. The drawer-shelf system of claim 5 further comprising a support bar (i) defining a third C-channel configured to receive a third portion of the outer edge of the planar shelf and (ii) configured to secure the third portion to front ends of the support rail and second support rail opposite to the back ends of the support rail and second support rail.

7. The drawer-shelf system of claim 6, wherein the third portion of the outer edge is a front edge of the planar shelf.

8. The drawer-shelf system of claim 6, further comprising first and second horizontally extending posts extending upward from the top surfaces of the support rail and second support rail and along the front ends of the support rail and second support rail, respectively, wherein the support bar defines a fourth C-channel below the third C-channel, and wherein the horizontally extending posts are each disposed within the fourth C-channel to secure the third portion of the outer edge of the planar shelf to the front ends of the support rail and second support rail.

9. The drawer-shelf system of claim 3, wherein the second support rail is configured to slidably engage the second shelf support to secure the second support rail to the refrigerator within the internal cavity.

10. A drawer-shelf system for a refrigerator comprising:

a crisper drawer having first and second ridges extending outward from opposing first and second sides of crisper drawer;

first and second opposing spaced-apart support rails, the first and second support rails (i) defining first and second channels along first and second internal sides of the first and second support rails, respectively, wherein the first and second channels receive the first and second ridges, respectively, to support the crisper drawer and such that the crisper drawer is slidable relative to the first and second support rails, and (ii) having first and second spaced-apart protrusions extending upward from first and second back ends of the first and second support rails, respectively, wherein the first and second protrusions define first and second C-channels, respectively, the first and second C-channels having first and second forward facing open ends, respectively, wherein exteriors of the first and second protrusions are configured to engage C-shaped notches defined by first and second opposing shelf supports extending laterally into an internal cavity defined by the refrigerator to secure a position of the drawer-shelf system within the internal cavity; and a planar shelf having an outer edge extending about an outer periphery of the shelf, wherein a back portion of the outer edge is disposed within the first and second C-channels such that the planar shelf is supported by the first and second back ends, and wherein a middle region of the back portion of the outer edge is disposed between and the first and second protrusions external of the first and second C-channels.

11. The drawer-shelf system of claim 10, wherein the first and second support rails are configured to slidably engage first and second shelf supports disposed within the internal cavity defined by the refrigerator, respectively, to secure the first and second support rails to the refrigerator.

12. The drawer-shelf system of claim 10 further comprising a support bar securing a front portion of the outer edge to first and second front ends of the first and second support rails, wherein the support bar defines a third C-channel having a rearward facing open end, and wherein the front portion is disposed within the third C-channel.

13. The drawer-shelf system of claim 12 further comprising first and second horizontally extending posts disposed on and extending upward from the first and second front ends of the first and second rails, respectively, wherein the support bar engages the first and second horizontally extending posts to secure the front portion to the first and second front ends.

14. The drawer-shelf system of claim 13, wherein the support bar defines a fourth C-channel below the third C-channel having a second rearward facing open end, and wherein the first and second horizontally extending posts are disposed within the fourth C-channel.

15. A drawer-shelf system for a refrigerator comprising:

a drawer having a ridge protruding therefrom;

a support rail (i) defining a first channel along a side of the support rail, wherein the first channel is configured to receive the ridge such that the drawer is slidable relative to and supported by the support rail and (ii) having a protrusion extending upward from a first end of the support rail, wherein the protrusion defines a second channel, and wherein an exterior of the protrusion is configured to engage a C-shaped notch defined by a shelf support extending laterally into an internal cavity defined by the refrigerator to secure a position of the drawer-shelf system within the internal cavity; and a shelf plate having an outer edge extending about an outer periphery of the shelf, wherein a first portion of the outer edge is configured to be disposed within the second channel such that the shelf plate is supported by the first end.

16. The drawer-shelf system of claim 15 further comprising a support bar configured to secure a second portion of the outer edge to a second end of the support rail, wherein (i) the support bar defines a third channel, (ii) the second portion is configured to be disposed within the third channel, (iii) the second end is opposite to the first end, (iv) and the second portion is opposite to the first portion.

17. The drawer-shelf system of claim 16, wherein the second channel and third channel are C-channels having open ends facing each other.

18. The drawer-shelf system of claim 16 further comprising a horizontally extending post disposed on and extending upward from the second end of the support rail, wherein the support bar engages the horizontally extending post to secure the second portion to the second end.

19. The drawer-shelf system of claim 18, wherein the support bar defines a fourth channel below the third channel, and wherein the horizontally extending post is disposed within the fourth channel.

20. The drawer-shelf system of claim 19, wherein the third channel and the fourth channel are stacked C-channels.

* * * * *